US006889596B2

(12) United States Patent
Meijers et al.

(10) Patent No.: US 6,889,596 B2
(45) Date of Patent: May 10, 2005

(54) COMPRESSOR COOLER AND ITS ASSEMBLY PROCEDURE

(75) Inventors: Marnix Meijers, Eindhoven (NL); Jeren C. Mullie, Eindhoven (NL); Antonius A. J. Benschop, Waalre (NL)

(73) Assignee: Thales Nederland B.V. (NL)

( * ) Notice: Subject to any disclaimer, the term of this patent is extended or adjusted under 35 U.S.C. 154(b) by 65 days.

(21) Appl. No.: 10/352,183

(22) Filed: Jan. 28, 2003

(65) Prior Publication Data

US 2003/0219350 A1 Nov. 27, 2003

(30) Foreign Application Priority Data

Jan. 29, 2002 (NL) ..... 1019858

(51) Int. Cl.[7] ..... F04B 17/04

(52) U.S. Cl. ..... 92/130 R; 92/223; 29/888.04; 29/8; 417/416

(58) Field of Search ..... 92/130 R, 233; 29/888.048, 890.035, 458; 417/416, 417, 418

(56) References Cited

U.S. PATENT DOCUMENTS 3,212,411 A 10/1965 Storms
3,213,411 A 10/1965 Loring
3,239,589 A 3/1966 White
5,318,412 A * 6/1994 Laskaris et al. ..... 417/417
5,333,536 A * 8/1994 Yuda ..... 92/155
5,435,233 A 7/1995 Bowell, Sr.
5,826,491 A * 10/1998 Steiger ..... 92/155
6,050,556 A 4/2000 Okumura et al.
6,092,999 A * 7/2000 Lilie et al. ..... 417/415
6,129,527 A * 10/2000 Donahoe et al. ..... 417/416
2001/0051099 A1 12/2001 Hagiwara et al.

FOREIGN PATENT DOCUMENTS

GB 2079204 A * 1/1982 ..... B21D/39/06

* cited by examiner

*Primary Examiner*—Edward K. Look
*Assistant Examiner*—Igor Kershteyn
(74) *Attorney, Agent, or Firm*—Lowe Hauptman & Berner, LLP

(57) ABSTRACT

A cryogenic refrigerator and more particularly, the cryogenic refrigerator compressor assembly procedure and to a mechanism for supporting piston for use in such a cryogenic refrigerator is described. Embodiments of the present invention solve the above-mentioned drawbacks by avoiding the radial movements of the piston. The assembly procedure of a cooler compressor comprises coating at least one piston by a material, placing each piston in the cylinder, raising the temperature up until a predetermined temperature so as the piston and/or its coat expands to occupy all the cylinder, fixing each piston in the cylinder in this position until the temperature returns to ambient temperature. Another object of this invention is the cooler compressor piston spring having two flexure bearings separated by a gap connected together by a first and an outer ring.

11 Claims, 3 Drawing Sheets

COMPRESSOR COOLER AND ITS ASSEMBLY PROCEDURE

RELATED APPLICATIONS

The present application is based on and claims priority from Netherlands Application Number 1019858, filed Jan. 29, 2002, the disclosure of which is hereby incorporated by reference herein in its entirety.

FIELD OF THE INVENTION

The present invention generally relates to cryogenic refrigerator and more particularly, the cryogenic refrigerator compressor assembly procedure and to means for supporting piston for use in such a cryogenic refrigerator.

BACKGROUND OF THE INVENTION

A conventional Stirling refrigerator is designed, for example, to cool infrared sensors and detectors in thermal imagers operating at a temperature of 60–140 K. Such conventional refrigerator generally comprises a compressor 10, and a cold finger 20 as shown by FIG. 1. The compressor 10 and the cold finger 20 are constructed as separate components connected together through a conduit 30. This split configuration provides maximum flexibility in system design and isolates the detector from the compressor-induced vibrations.

The compressor 10 includes a cylinder fit 12 within a compressor housing 11. In the example of FIG. 1, two pistons 13 are mounted for reciprocal action within the cylinder 12. The use of dual-opposed pistons driven by linear motors minimises compressor vibration and acoustic noise. A helical suspension spring 14 is horizontally disposed between each piston 13 and the compressor housing 11. A compression chamber 15 having a variable volume is defined in the cylinder 12 between the two pistons 13. The pistons 13 are driven by linear motor using coil placed inside the working gas. The coil is attached to the piston 13. A permanent magnet 18 is connected to the compressor housing 11.

The cold finger 20 includes a cylinder 23 within which a displacer 24 is reciprocal. A regenerator or regenerative heat exchanger is integrated in the displacer 24. A helical displacer spring 25 is disposed under the displacer 24.

The gas pressure fluctuations in the compression chamber 15 acts on the spring load displacer 25. This gas spring system is tuned to provide a good practical approximation to the ideal phase relationship between the displacer 24 and the pistons 13. Refrigeration occurs around the top 21 of the cold finger 20, which contains an expansion space 27. The displacer 24 separates this space 27 from a compression space consisting of the space 15 between the two pistons 13, the space in the split tube 30 and the space below the warmer end of the displacer 24.

The phase difference between the movement of the displacer and the movement of the piston is designed in such a way that compression occur when the expansion space is small and expansion of the gas occurs when the expansion space is large. In this way, more gas in the expansion space is being expanded and cooled than it is compressed (and heated). Thus resulting in a net cooling effect generated at the top of the cold finger in the expansion space.

In the start of the first phase of the Stirling cycle, the gas is in The compression chamber 15 at ambient temperature and the displacer 24 is in the top 21 of the cold finger 20. The pistons 13 are driven inwards, compressing the gas. This process is nearly isothermal; the heat output being dissipated via heat sinks around the compressor 10 and the base of the cold finger 10. To reduce the required heatsink capacity of the warm end of the cold finger 20, the cooler is equipped with a Heatstop™ 40 in the cold finger 20 or transfer line 30.

SUMMARY OF THE INVENTION

Due to their applications: civil, space, telecom as well as military ones, coolers require long lifetime from at least 4 000 hours up to more than 40 000 hours. During the Stirling cycle, the movements of the pistons 13 in the cylinder 12 cause contacts between the pistons 13 and the cylinder 12 resulting in piston wear and thus increase of the gap between piston and cylinder. When this gap increases, the efficiency of the cooler decreases until a point at the cooling requirements are no longer achieved. This lifetime reduction is essentially due to the radial movements of the pistons 13 causing rubbing contacts with the cylinder 12.

This invention solves the above-mentioned drawbacks by avoiding the radial movements of the piston. An object of this invention is the assembly procedure of a cooler compressor comprising the following steps:

At least one piston 13 is coated by a material,

Each piston 13 is placed in the cylinder 12,

The temperature is raised up until a predetermined temperature so as the piston 13 and/or its coat 131 expanse to occupy all the cylinder 12, Each piston 13 is fixed in the cylinder in this position, The temperature returns to ambient temperature.

The assembly procedure according to this invention could comprise also the step of fixing the piston 13 in the cylinder 12 by connecting the piston 13 to the compressor housing 11 by high radial stiffness springs 16. Furthermore, this said connection of the piston 13 to the compressor housing 11 is done to a first area of the compressor housing at the front end of the piston 13 and to a second area of the compressor housing at the back end of the piston 13. Moreover, one possible assembly procedure step of this invention is that:

each piston 13 is connected indirectly to the first area of the compressor housing 11 by welding the spring outer part to this said first area of the compressor housing 11 and spring inner part to the top of a support 19 whose bottom is welded perpendicular to the piston support 132, and each piston 13 is fixed directly to the second area of the compressor housing 11 by welding the spring outer part to this said second area of the compressor housing 11 and the spring inner part to piston appendix 133.

Besides, the springs 16 could comprise two flexure bearings 162 mounted together separated by a small gap.

Another object of this invention is the cooler compressor piston spring comprising two flexure bearings 162 separated by a gap connected together by a first and a outer rings 161 and 163.

Moreover, the present invention proposes a cooler compressor comprising:

a compressor housing 11, a cylinder 12 included in this said compressor housing 11, at least one piston 13 inside this said cylinder 12, a compression chamber 15 defined by at least the top surface of sald piston 13 with an output 12 to connect the transfer line 30 linked to the cold finger 20, spring 14 between the bottom surface of each piston 13 and the compressor housing 11, each piston 13 has a concentric position inside the said cylinder 12.

BRIEF DESCRIPTION OF THE DRAWING

Further features and advantages of the invention will be apparent from the following description of examples of embodiments of the invention with reference to the drawing, which shows details essential to the invention, and from the claims. The individual details may be realised in an embodiment of the invention either severally or jointly in any combination.

DETAILED DESCRIPTION OF THE INVENTION

In the following description, the described example of compressor 10 according to the invention has two pistons 14. But the invention could also be applied to a one-piston compressor. By using two pistons, especially dual-opposed pistons as shown in the following examples, the compressor vibration and acoustic noise are minimised.

Figure 1:
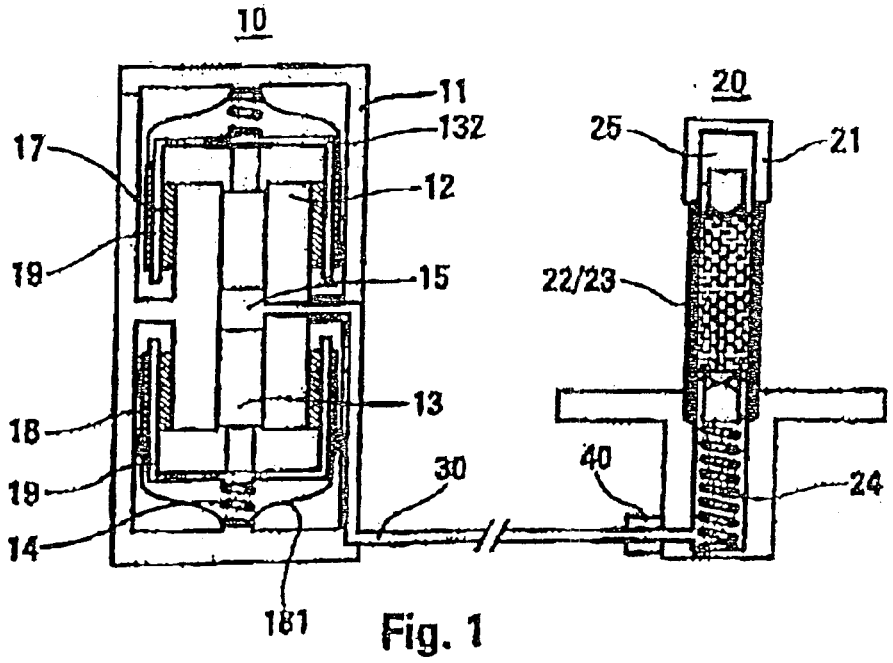
Fig. 1 PRIOR ART
FIG. 1, a cryogenic cooler refrigerator according to the state of the art.
Figures 2A, 2B, 2C:
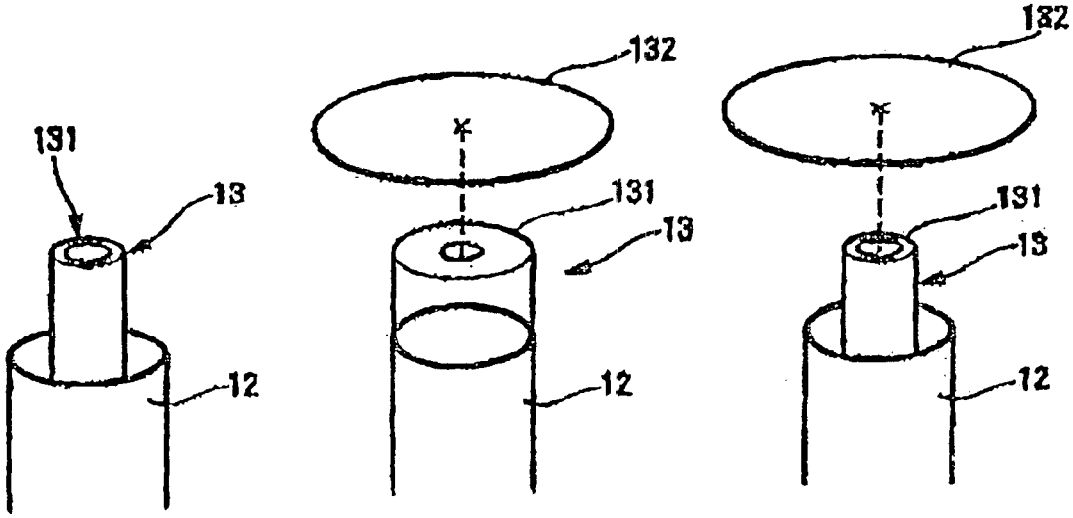
FIGS. 2*a*, 2*b* and 2*c*, the three mounting step of the piston in the cylinder according to the cooler compressor assembly procedure of the invention, FIG. 3, an example of cryogenic cooler refrigerator according to the invention, FIGS. 4*a*, 4*b* and 4*c*, upper view, cut view of an high radial stiffness spring using flexure bearings according to one embodiment of the invention and flexure bearing, FIG. 5, partial cut view of an example of cryogenic cooler compressor according to the invention, FIG. 6, detailed representation of an example of the magnet cylinder shown in the FIG. 5, FIG. 7, detailed representation of an example of the coil cylinder shown in the FIG. 5.

The cooler compressor assembly procedure according to the invention comprises several steps. The piston FIGS. 2*a*, 2*b* and 2*c* show the mounting of one piston 13 inside the cylinder 12. The piston 13 is placed inside the cylinder 12 at ambient temperature (20° C. for example) as shown by FIG. 2*a*.

In order to prevent piston rubbing against the cylinder inner wall, the piston 13 should be placed concentric in the cylinder 12 with a small gap. So, the diameter of the piston 13 including its coat 131 and the diameter of the cylinder are determined to have a thin gap with a predetermined dimension (10 $\mu$ for example) everywhere between the piston 13 and the cylinder 12. The materials used for the piston 13 and/or its coat 131 have a larger thermal expansion coefficient than the material of the cylinder 12. An example of material of the coat 131 is a material having high wear resistance, for example synthetic material.

The temperature is raised up until a predetermined temperature so the piston 13 and/or its coat 131 expanses itself for the piston 12 to occupy the entire cylinder 12 as shown by FIG. 2*b*. The predetermined temperature is much higher than the working temperature of the compressor 10. So, the materials used for the piston 13 and/or its coat 131 are also chosen for their expansion properties. The material properties of the piston 13 and/or its coat 131 and their dimensions are such as the piston 13 and/or its coat 131 expanse enough for the piston 13 to fill completely the inner part of cylinder 12 at the predetermined temperature. But the piston 13 and/or its coat 131 should not expanse, or expanse so slightly in comparison with gap dimension. So, the dimensions of this piston 13 and/or its coat 131 are chosen to fulfil these criteria. For example, a Teflon coat 131 of 20 $\mu$ for the piston 13 expanses 20 times at 120° C.

As the piston 13 and/or its coat 131 expanse uniformly in any direction, the piston 13 is well aligned in the cylinder 12 at this said predetermined temperature. The cylinder 12 and the piston 13 are nicely concentric. Thus, the piston 13 is fixed in this position. For example the piston 13 is fixed in relation to the cylinder 12 to its support 132 as shown on FIG. 2*b*. Another alternative is to connect the piston to the compressor housing 11 by spring 16 as shown on FIG. 3 to fix the relative position between the piston 13 and the cylinder 12.

The following step consists to return to an ambient temperature so the piston 13 and/or its coat 131 shrinks to its normal dimensions as shown by FIG. 2*c*. As the piston 13 is fixed relatively to the cylinder 12 by the support 132 for example, the piston 13 stays concentrically positioned with respect to the cylinder 12.

Moreover, the material used for coating the piston 13 could be wear resistant.

Figure 3:
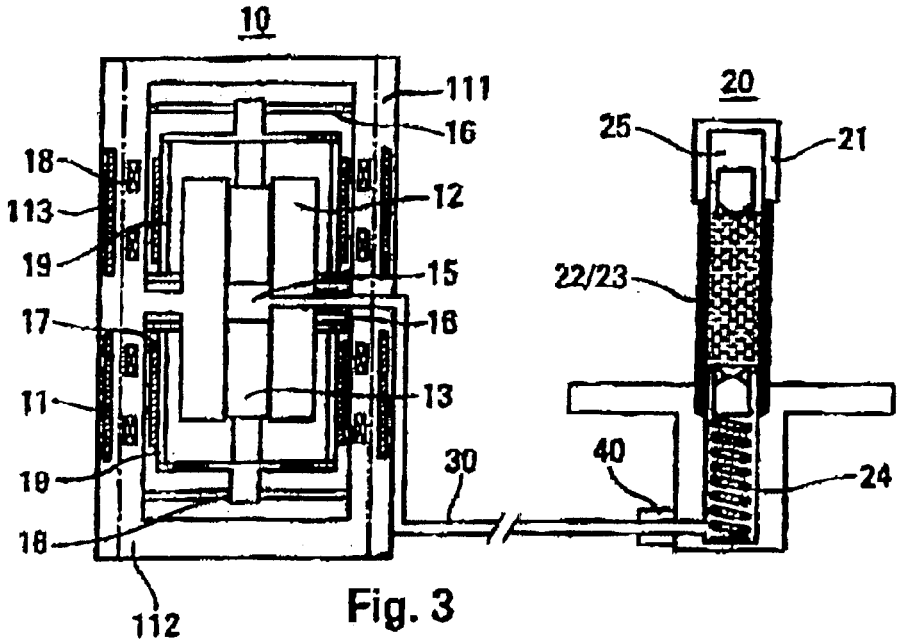

FIG. 3 shows an example of cooler according to the invention. As conventional refrigerator in general, it comprises a compressor 10, and a cold finger 20. The compressor 10 and the cold finger 20 are constructed as separate components connected together through a conduit 30. This conduit 30 could be a malleable metal transfer line. This split configuration provides maximum flexibility in system design and isolates the detector from the compressor-induced vibrations.

The compressor 10 includes a cylinder fit 12 within a compressor housing 11. In the example of FIG. 3, two pistons 13 are mounted for reciprocal action within the cylinder 12. A small clearance allows the two pistons 13 to move easier in the cylinder 12. At least a high radial stiffness spring 16 is disposed between each piston 13 and the compressor housing 11.

FIG. 3 shows an example with two high radial stiffness springs 16 per piston 13 connecting directly and inderectly the piston 13 to the compressor housing 11. Each piston 13 is connected indirectly to the first area of the compressor housing 11 by welding the spring outer part to this said first area of the compressor housing 11 and spring inner part to the top of a support 19 whose bottom is welded perpendicular to the piston support 132, and fixed directly to the second area of the compressor housing 11 by welding the spring outer part to this said second area of the compressor housing 11 and the spring inner part to piston appendix 133.

A compression chamber 15 having a variable volume is defined in the cylinder 12 between the two pistons 13. The pistons 13 are driven by linear motor.

The cold finger 20 includes a low temperature cylinder 23 within which a displacer 24 is reciprocal. A regenerator or regenerative heat exchanger is mounted within the displacer 24. Displacer springs 25 are disposed under the displacer 24.

The gas pressure fluctuations in the compression chamber 15 acts on the spring load displacer 25. This gas spring system is tuned to provide a good practical approximation to the ideal phase relationship between the displacer 24 and the pistons 13. Refrigeration occurs around the top 21 of the cold finger 20, which contains an expansion space 27. The displacer 24 moves gas into and out this space 27 from a compression space consisting of the space 15 between the two pistons 13, the space in the split tube 30 and the space below the warmer end of the displacer 24.

Figure 4C:
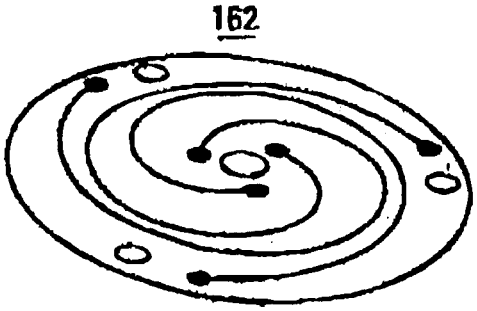
Figure 4A:
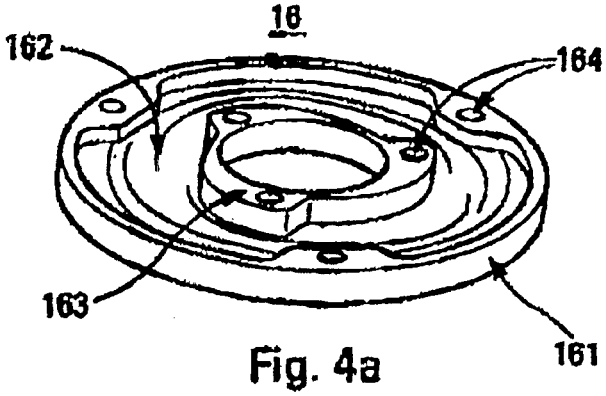
Figure 4B:
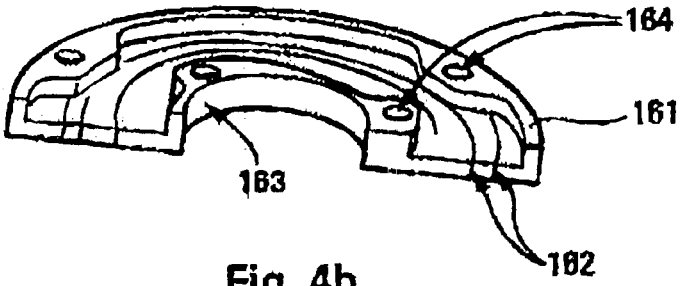

The springs 16 according to the invention prevent the piston 13 from radial movements. For example, they could use flexure-bearing technology as shown by FIGS. 4*a*, 4*b* and 4*c*. Due to the combination of a plurality of flexure bearings, the spring 16, named flexure bearing pack, avoids the radial movements. As shown on FIGS. 4*a* and 4*b*, two flexure bearings 162 are combined by being mounted together by an inner and an outer ring 161 and 163.

The inner ring 161 of the flexure bearing pack 16 fixed to the first area of the compressor housing 11 could have a slightly larger diameter than the outer diameter of the cylinder 12. The inner ring 161 of the flexure bearing pack 16 fixed to the second area of the compressor housing 11 could have a slightly larger diameter than the outer diameter of the piston appendix 133

The high radial spring 16 could be fixed to the compressor housing 11, to the piston 13 or the support 19 by at least one of its first or outer ring 161 or 163. Fixations 164 as shown on FIGS. 4*a* and 4*b* could be used in this purpose or spring 16 could be laser welded. By welding, for example laser welding or other connections techniques, the inner and outer ring 161 and 163 don't need to be so thick anymore so the spring 16 could become thinner. Furthermore, laser-welding fixation avoids radial movements too.

In order to use a limited number of flexure bearings 162 and to have still no radial movements, the flexure bearings have a high radial stiffness. They are separated by a gap . In the example shown by FIG. 4*b*, the spring 16 comprises only two flexure bearing 162 separated by a thin gap. Thus, the spring 16 gets a high radial stiffness. The two-flexure bearings are welded, for example laser welded, to the first and outer ring 161 and 163.

FIG. 4*c* shows a flexure bearing 162. It consists in a circle plate that comprises optimised extensive design carvings. The optimised extensive design could be calculated using Finite Element Modelling.

Figure 5:
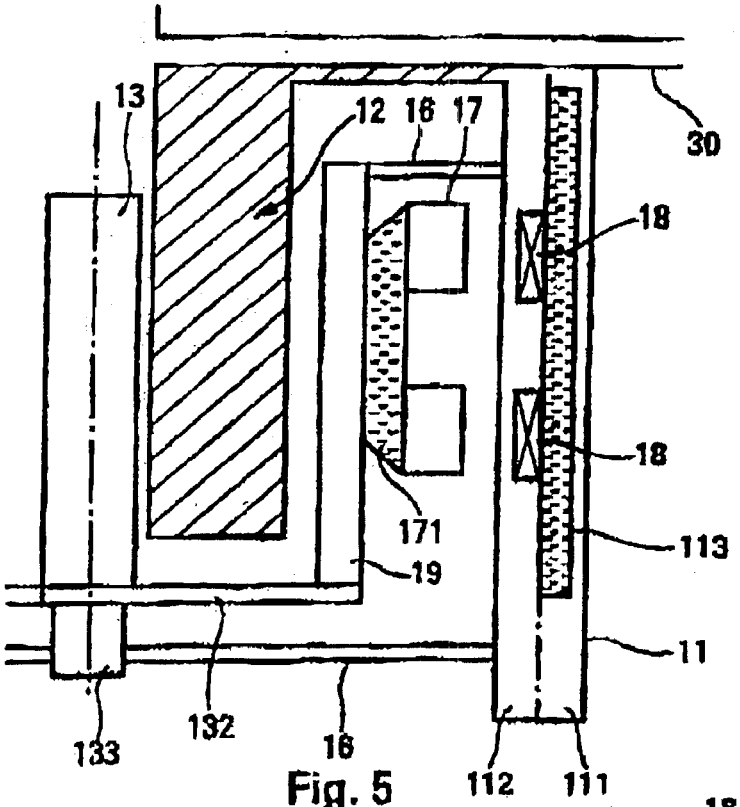

Each piston 13 is motor driven by moving-magnet linear motor as shown by FIGS. 3 and 5. That means that the magnets 17 are linked to the piston 13 by being placed against the inner wall of a support cylinder 19 fixed to the piston support 132. The diameter of this support cylinder 19 is bigger than the diameter of the cylinder 12 so the magnets 17 are outside the cylinder 12. The coils 18 are fixed outside the inner part 112 of the compressor housing 11 so there is no need for flying leads. In addition, as the coils 18 are placed outside of the working gas, there is no problem of gas contamination.

The only subsisting problem is the eddy current inside the compressor housing 11 due to the place of the coils 18. It is solved by using a high current resistant material (as for example steel with such properties and good magnetic properties) as coil surrounding part 113 in the outer part 112 of the compressor housing 11. The magnets 17 are fixed to their supports 19 via a fixing part 171. This magnet fixing part 17 and the coil surrounding part 113 are used to enclose the magnetic field. They could be made in iron to have such properties.

So, the other parts of the compressor can be made in any kind of material, even material which don't have good magnetic properties. For example, for space applications, the compressor housing inner and outer part 112 and 111, and/or the cylinder 12, and/or the magnet support 19 could be made in a lighter material as, for example, Titanium.

Figure 6:
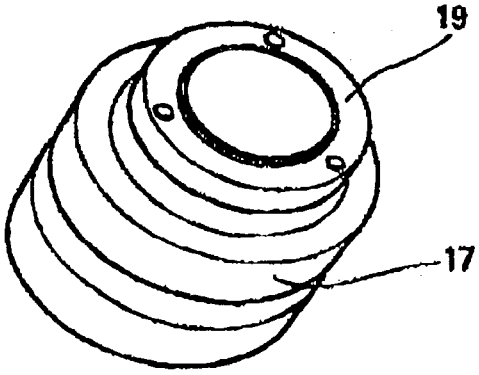
Figure 7:
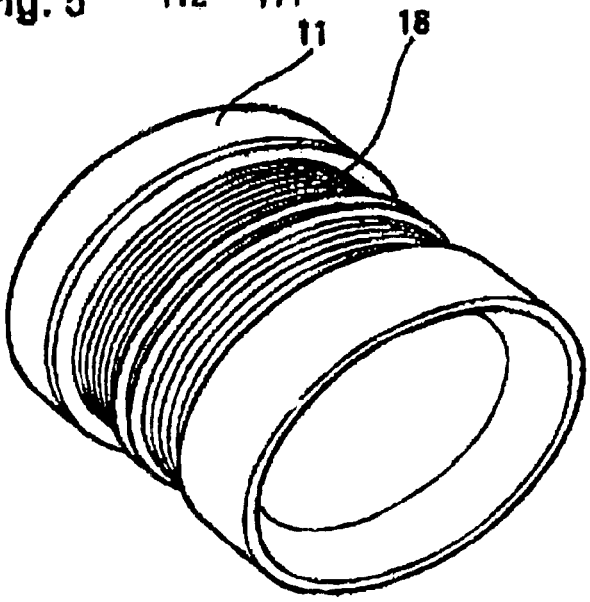

FIG. 6 shows more precisely an example of magnets 17. The magnets 17 have annular form and are placed against the outer wall of the support cylinder 19. The coils 18 could be rolled up over placed over the external wall of the inner part 112 of the compressor housing 11 as shown by FIG. 7. So the coils are separated from the working gas by at least the inner wall of the compressor housing 11.

For avoiding as much radial movements as possible, all the fixations could be done by welding, for example laser welding, or by any connection techniques in order all the parts of the compressor 10 (each parts 111, 112, 113 of the compressor housing 11, piston(s) 13, cylinder 12, magnets 17, coils 18, spring 16 . . . ) are linked to make one.

Conventional compressor are constructed with a small initial gap between the piston 13 and the cylinder 12. The use of such conventional compressor creates a gap between the piston 13 and the cylinder 12 which is increasing with the working hours of the compressor due to the rubbing of the piston against the cylinder inner wall.

Thanks to the invention, the relative position between the piston 13 and the cylinder 12 remains constant. So, the size of the small gap (for example 10 $\mu$ gap) between the piston 13 and the cylinder 12 is the same after many compressor working hours.

What is claimed is:

1. Assembly procedure of a cooler compressor comprising the following steps:

coating at least one piston with a material;

placing each piston in a cylinder; and raising the temperature until a predetermined temperature so as the created piston expands to occupy substantially all the cylinder;

wherein each piston is fixed in the cylinder in this position until the temperature returns to ambient temperature.

2. Assembly procedure according to claim 1, wherein the material and the dimensions of the piston are such as the piston expands enough for the piston to fill completely the inner part of the cylinder at the predetermined temperature.

3. Assembly procedure according to claim 1, wherein the piston coat material is Teflon™ based.

4. Assembly procedure according to claim 1, wherein the piston is operatively connected to a compressor housing by at least one spring.

5. Assembly procedure according to claim 4, wherein each piston is connected indirectly to a first area of the compressor housing by welding the spring outer part to the first area of the compressor housing and spring inner part to a top of a support whose bottom is welded perpendicular to the piston support, and each piston is fixed directly to a second area of the compressor housing by welding the spring outer part to the second area of the compressor housing and the spring inner part to a piston appendix.

6. Assembly procedure according to claim 5, wherein the spring is a high radial stiffness spring.

7. Assembly procedure according to claim 6, wherein the spring comprises two flexure bearings separated by a gap connected together by a first and an outer ring.

8. Assembly procedure according to claim 7, wherein the spring is connected to the piston by welding its inner ring and welded to the compressor housing by its outer ring.

9. Assembly procedure according to claim 8, wherein the flexure bearing includes a circle plate that comprises optimized extensive design carvings.

10. Assembly procedure according to claim 9, wherein the optimized extensive design is calculated using finite element modeling.

11. Assembly procedure according to claim 4, wherein the operative connection of the piston to the compressor housing is at least one of direct and indirect.

* * * * *